US005551789A

United States Patent [19]

Okawa et al.

[11] Patent Number: 5,551,789

[45] Date of Patent: Sep. 3, 1996

[54] COSMETIC MATERIAL CONTAINER

[75] Inventors: Akira Okawa; Yuji Sugaya, both of Tokyo, Japan

[73] Assignee: Kawakami Giken Co Ltd, Nakatsugawa, Japan

[21] Appl. No.: 317,549

[22] Filed: Oct. 4, 1994

[30] Foreign Application Priority Data

Oct. 13, 1993 [JP] Japan ..... 60018 U

[51] Int. Cl.[6] ..... B43K 8/04; B43K 9/00

[52] U.S. Cl. ..... 401/199; 401/202; 401/247

[58] Field of Search ..... 401/199, 247, 401/202

[56] References Cited

U.S. PATENT DOCUMENTS

| | | | |
|---|---|---|---|
| 4,645,367 | 2/1987 | Mutschler et al. | 401/199 |
| 4,671,692 | 6/1987 | Inaba | 401/199 |
| 4,917,522 | 4/1990 | Kay et al. | 401/247 X |

FOREIGN PATENT DOCUMENTS

| | | | |
|---|---|---|---|
| 256615 | 2/1988 | European Pat. Off. | 401/209 |
| 6127186 | 5/1994 | Japan | 401/199 |
| 1207268 | 9/1970 | United Kingdom | 401/247 |
| 2072587 | 10/1981 | United Kingdom | 401/199 |
| 9104873 | 4/1991 | WIPO | 401/199 |

*Primary Examiner*—Steven A. Bratlie

*Attorney, Agent, or Firm*—Beveridge, DeGrandi, Weilacher & Young, LLP

[57] ABSTRACT

A cosmetic material container comprises: a sleeve holder 1 having an open front end 12 and an open rear end 11; a tail plug 2 for closing the open rear end 11 of the sleeve holder 1; an applying tip unit 3 secured to an open front end side of the sleeve holder 1; and a double cap unit 4 attachably and detachably coupled to the sleeve holder 1 on the outer periphery of its front end 12, the applying tip unit 3 including an adjuster 31 provided on its outer periphery with annular grooves 311, a porous joining core 32 inserted into an axial hole 312 in the adjuster 31 and communicating with a part of the annular grooves 31, and a porous tip 33 connected to a front end of the joining core 32 and inserted in a socket 313 provided in a front end of the adjuster 31, a cosmetic material reservoir 13 being defined between a rear end of the adjuster 31 and the tail end 2 in the sleeve holder 1, and the porous joining core 32 being disposed in the adjuster 31 to project its rear end in the reservoir 13.

2 Claims, 8 Drawing Sheets

COSMETIC MATERIAL CONTAINER

BACKGROUND OF THE INVENTION

1. Field of the Invention

This invention relates to a cosmetic material container which applies a liquid cosmetic material such as an eyeliner or the like to a part of a face.

2. Statement of the Prior Art

For convenience of explanation, conventional cosmetic material containers will be described below by referring to FIGS. 11 through 14. FIG. 11 is a longitudinal sectional view of a conventional cosmetic material container. FIG. 12 is a longitudinal sectional view of another conventional cosmetic material container. FIG. 13 is a longitudinal sectional view of a cartridge part shown in FIG. 12. FIG. 14 is a longitudinal sectional view of a conventional direct water ink ejecting pen.

In a conventional cosmetic material container shown in FIG. 11, an applying tip 101 is attached to a front end of a sleeve holder 100. A cotton piece 102 containing a cosmetic material is charged into an interior of the sleeve holder 100. The cotton piece 102 is closed in the interior of the sleeve holder 100 by a cotton piece closure 103 and a tail plug 104.

However, it is diffcult in such a construction to make full use of the cosmetic material contained in the cotton piece 102 for when the remaining amount of the cosmetic material contained in the cotton piece 102 decreases the absorption of the applying tip 101 weakens such that the cosmetic material is not supplied enough into the applying tip 101, thereby causing the cosmetic material container to be out of use while retaining a lot of the cosmetic material in the cotton piece 102. This is not economical. As the cosmetic material contained in the cotton piece 102 decreases, the applying tip 101 weakens and its material cannot percolate into the whole applying tip 101.

Consequently, the container will not be used, although much cosmetic material remains in the cotton piece 102. This is not economical.

On the other hand, in another conventional cosmetic material container shown in FIGS. 12 and 13, a reservoir 200 for cosmetic material is a cartridge type. Thus, an applying tip unit 300 requires a special connector 301 on its rear end.

Further, after the cosmetic material is charged in the cartridge type reservoir 200, the reservoir must be closed by a ball or the like. Accordingly, production cost becomes relatively high on account of a separate member as cartridge.

Further, in a conventional direct ink ejecting pen shown in FIG. 14, an applying tip unit 500 is attached to an open front end of a sleeve holder 400 having a bottom wall at its rear end. A rear portion of the sleeve holder 400 defines a ink reservoir 401. The applying tip unit 500 includes a pen tip 501, a front plug 502, an adjuster 503 and a joining core 504.

Heretofore, there was no cosmetic material container having the above construction. However, in the case that the above construction is applied to the cosmetic material container as it is, a problem involving a sterilizing process will occur. That is, the parts constituting the sleeve holder 400 and applying tip unit 500 must be sterilized individually, the applying unit 500 is first assembled under sterilizing atmosphere. After the cosmetic material is charged in the sleeve holder 400, applying tip unit 500, cap and the like must be combined. This requires an additional sterilizing atmospheric system and the combining step becomes difficult.

SUMMARY OF THE INVENTION

An object of the present invention is to provide a cosmetic material container which can minimize the number of sterilizing steps of the constituent parts.

Another object of the present invention is to provide a cosmetic material container which can make full use of the cosmetic material charged therein.

Still another object of the present invention is to provide a cosmetic material container which can minimize the number of constituent parts and can be inexpensively produced.

In order to achieve the above objects, a cosmetic material container comprises: a sleeve holder having an open front end and an open rear end; a tail plug for closing the open rear end of the sleeve holder; an applying tip unit secured to an open front end side of the sleeve holder; and a double cap unit attachably and detachably coupled to the sleeve holder on the outer periphery of its front end.

The applying tip unit includes an adjuster provided on its outer periphery with a number of annular grooves, a porous joining core inserted into an axial hole in the adjuster and communicating with a part of the annular grooves, and a porous tip connected to a front end of the joining core and inserted in a socket provided in a front end of the adjuster.

A cosmetic material reservoir is defined between a rear end of the adjuster and the tail end in the sleeve holder.

The porous joining core is disposed in the adjuster to project its rear end in the reservoir.

The double cap unit includes an outer cap, an inner cap and a compression coil spring. The inner cap is biased outwardly by the spring so that the inner cap linearlly contacts with the outer periphery of the front end of the sleeve holder when the double cap unit is coupled to the sleeve holder.

The sleeve holder is provided on its middle interior with a stepped portion and projections, the stepped portion being formed by a difference in its inner diameters. The adjuster is secured in the sleeve holder when a rear end of the adjuster is clamped between the stepped portion and the projections.

The sleeve holder is provided on the outer periphery of the front end with a converged tappered portion. The sleeve holder is provided on its interior with at least one vent slot extending in an axial direction.

The adjuster is provided on its outer periphery with at least one slit extending from its front end to its rear end. At least a part of the slit communicates with the axial hole in the adjuster.

DETAILED DESCRIPTION OF THE PREFERRED EMBODIMENTS

An embodiment of a cosmetic material container in accordance with the present invention will be described below by referring to FIGS. 1 through 10.

Figure 1:
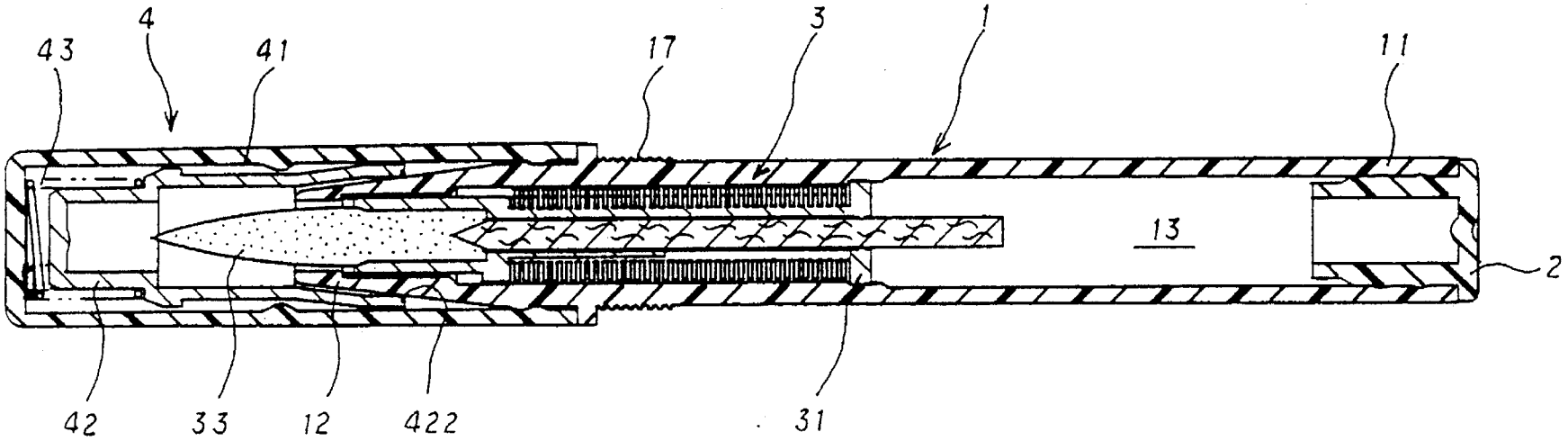
FIG. 1 is a longitudinal sectional view of a cosmetic material container of the present invention.

As shown in FIG. 1, a cosmetic material container of this invention comprises: a sleeve holder 1 having an open front end 12 and an open rear end 11; a tail plug 2 for closing the open rear end 11 of the sleeve holder 1; an applying tip unit 3 secured to an open front end side of the sleeve holder 1; and a double cap unit 4 attachably and detachably coupled to the sleeve holder 1 on the outer periphery of its front end 12.

Figure 6:
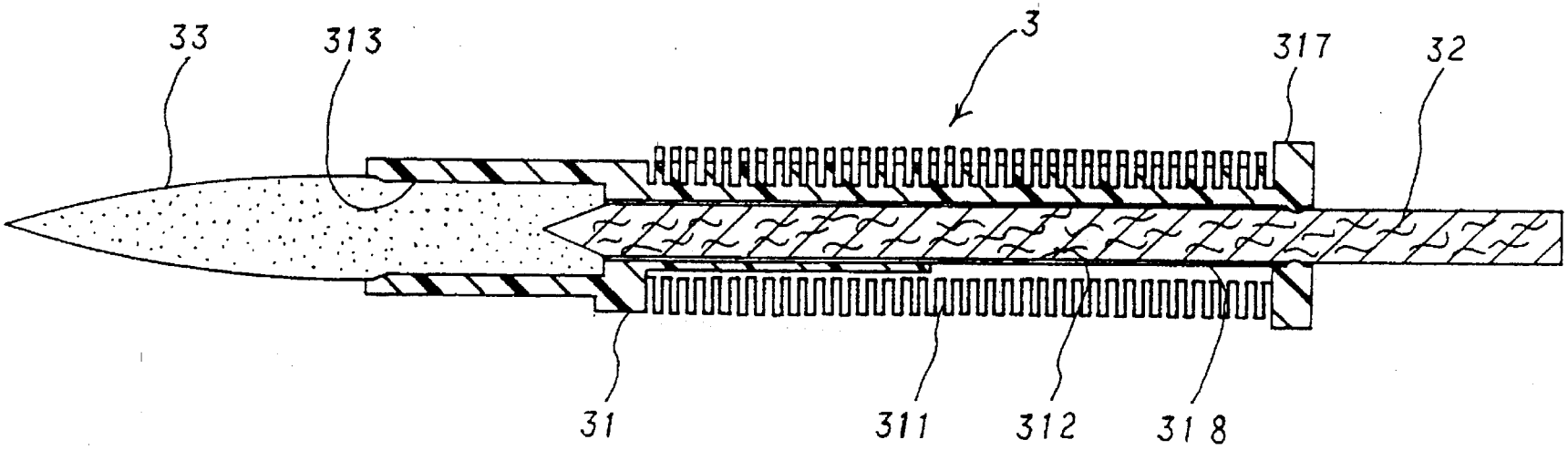
FIG. 6 is a longitudinal sectional view of an applying tip unit.
Figure 7:
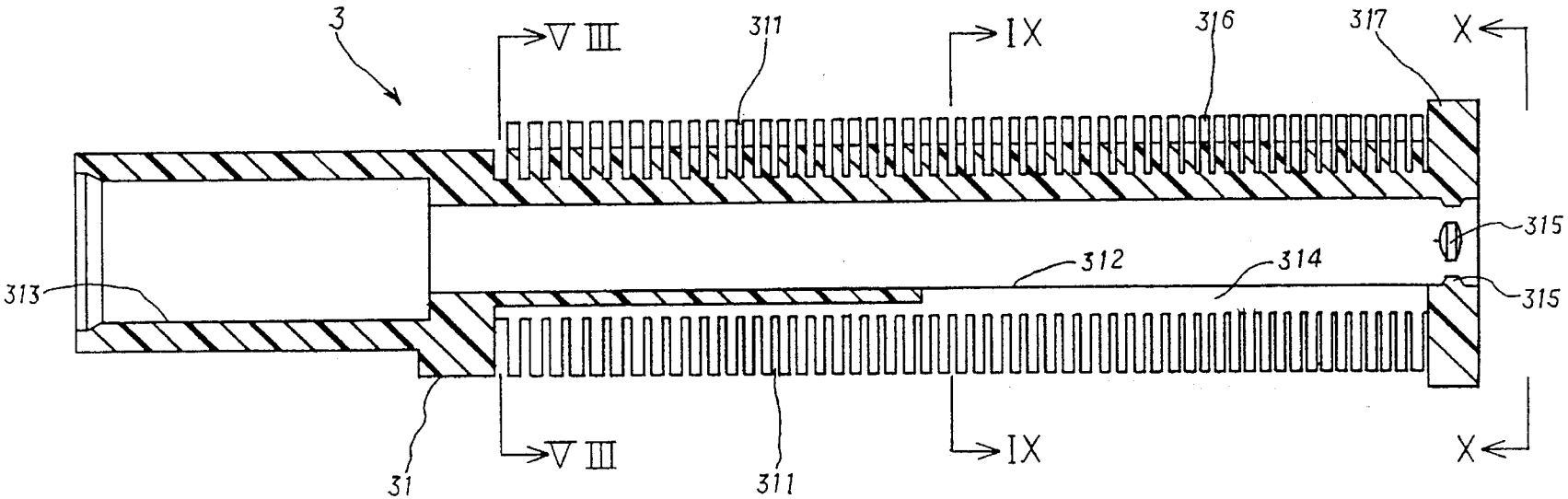
FIG. 7 is an enlarged longitudinal sectional view of an adjuster.
Figure 10:
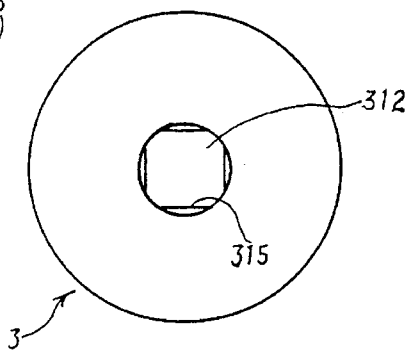
FIG. 10 is an end face view taken along lines X—X in FIG. 7.
Figure 9:
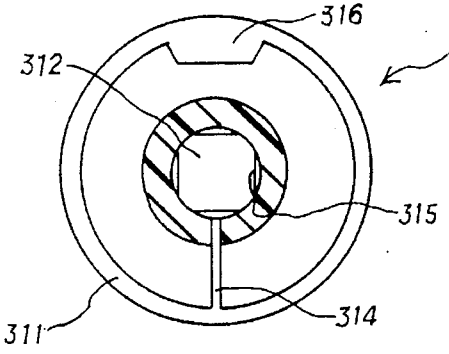
FIG. 9 is a corss sectional view taken along lines IX—IX in FIG. 7.
Figure 8:
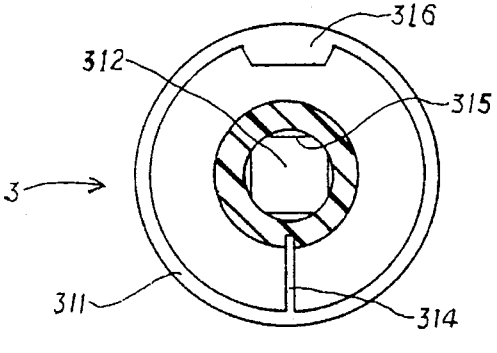
FIG. 8 is a corss sectional view taken along lines VIII—VIII in FIG. 7.
Figure 11:
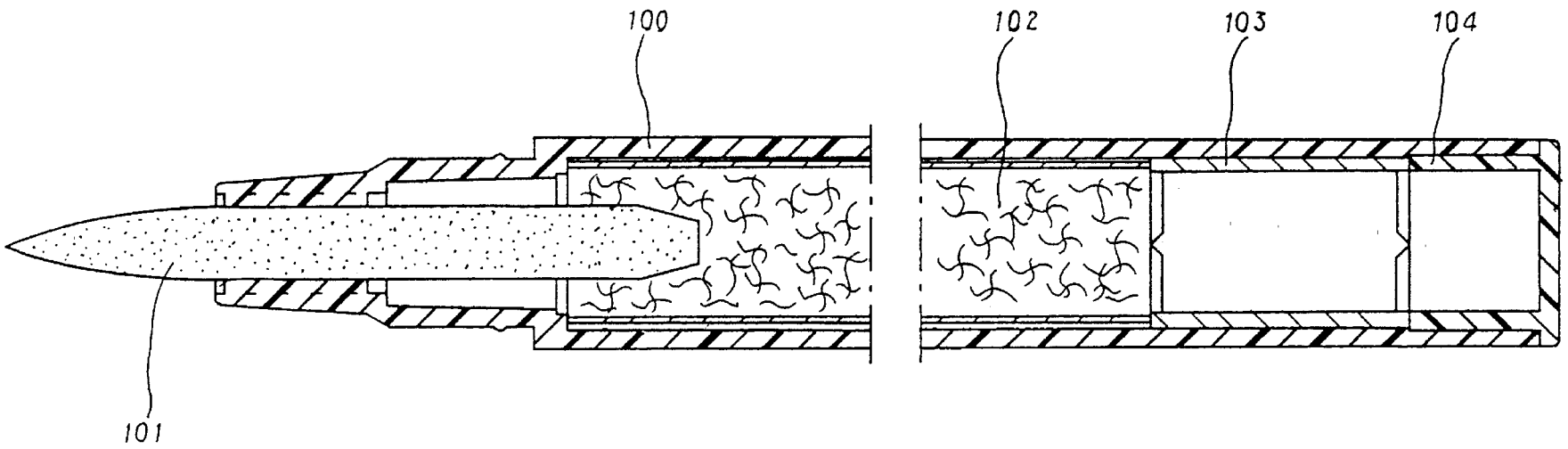
FIG. 11 PRIOR ART
FIG. 11 is a longitudinal sectional view of a conventional cosmetic material container.
Figure 12:
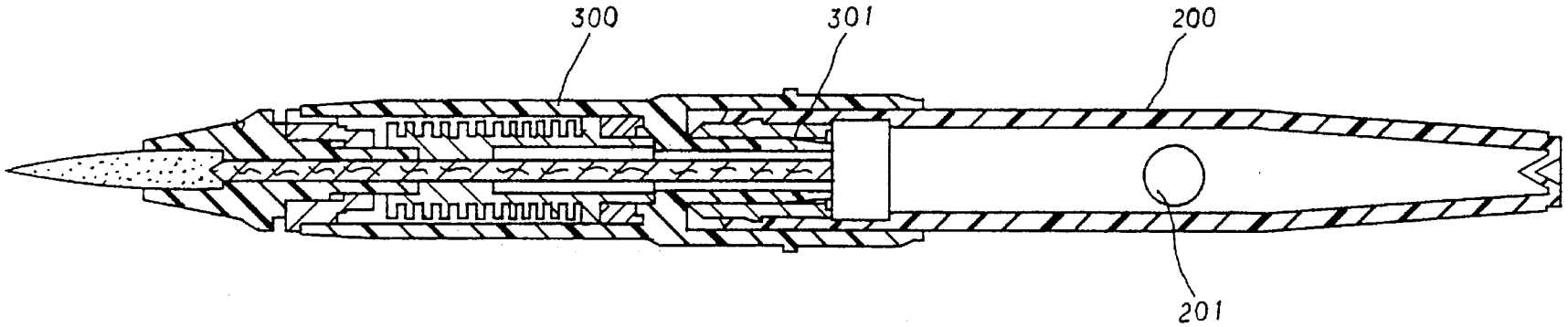
FIG. 12 PRIOR ART
FIG. 12 is a longitudinal sectional view of another conventional cosmetic material container.
Figure 13:
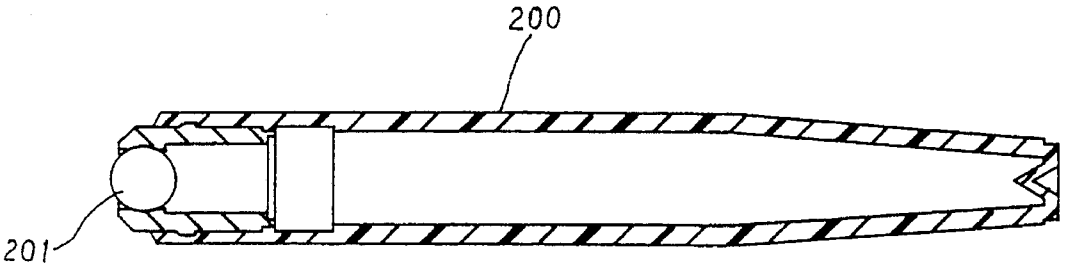
FIG. 13 PRIOR ART
FIG. 13 is a longitudinal sectional view of a cartridge part shown in FIG. 12.
Figure 14:
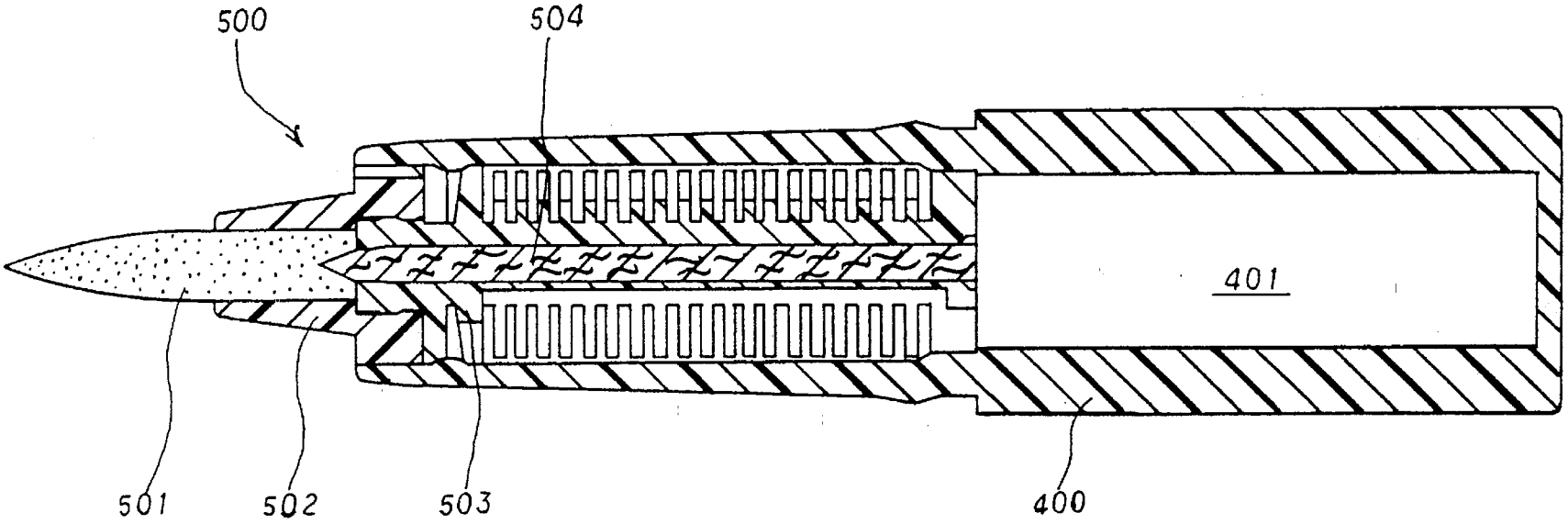
FIG. 14 PRIOR ART
FIG. 14 is a longitudinal sectional view of a conventional direct water ink ejecting pen.

As best shown in FIGS. 6 and 7, the applying tip unit 3 includes an adjuster 31 provided on its outer periphery with a number of annular grooves 311, a porous joining core 32 inserted into an axial hole 312 in the adjuster 31 and communicating with a part of the annular grooves 311, and a porous tip 33 connected to the joining core 32 and inserted in a socket 313 provided in a front end of the adjuster 31.

As best shown in FIG. 1, a cosmetic material reservior 13 is defined between a rear end of the adjuster 31 and the tail plug 2 in the sleeve holder 1. The rear end of joining core 32 projects in the reservoir 13.

In this embodiment, the cosmetic material may be, for example, an eyeliner in liquid. Also, preferably, the applying tip 33 and joining core 32 are made of a fibrous or porous material such as acrylic, polyester fibers and the like, which are suitable for absorbing and holding the liquid cosmetic material.

The joining core 32, as best shown in FIG. 6, can absorb and eject the cosmetic material through its whole length.

The tail plug 2 is usually made of a polypropylene resin. In the case that it is made of a nylon resin, it can absorb water in the cosmetic material to enhance water-sealing, thereby preventing the cosmetic material from leaking.

Figure 2:
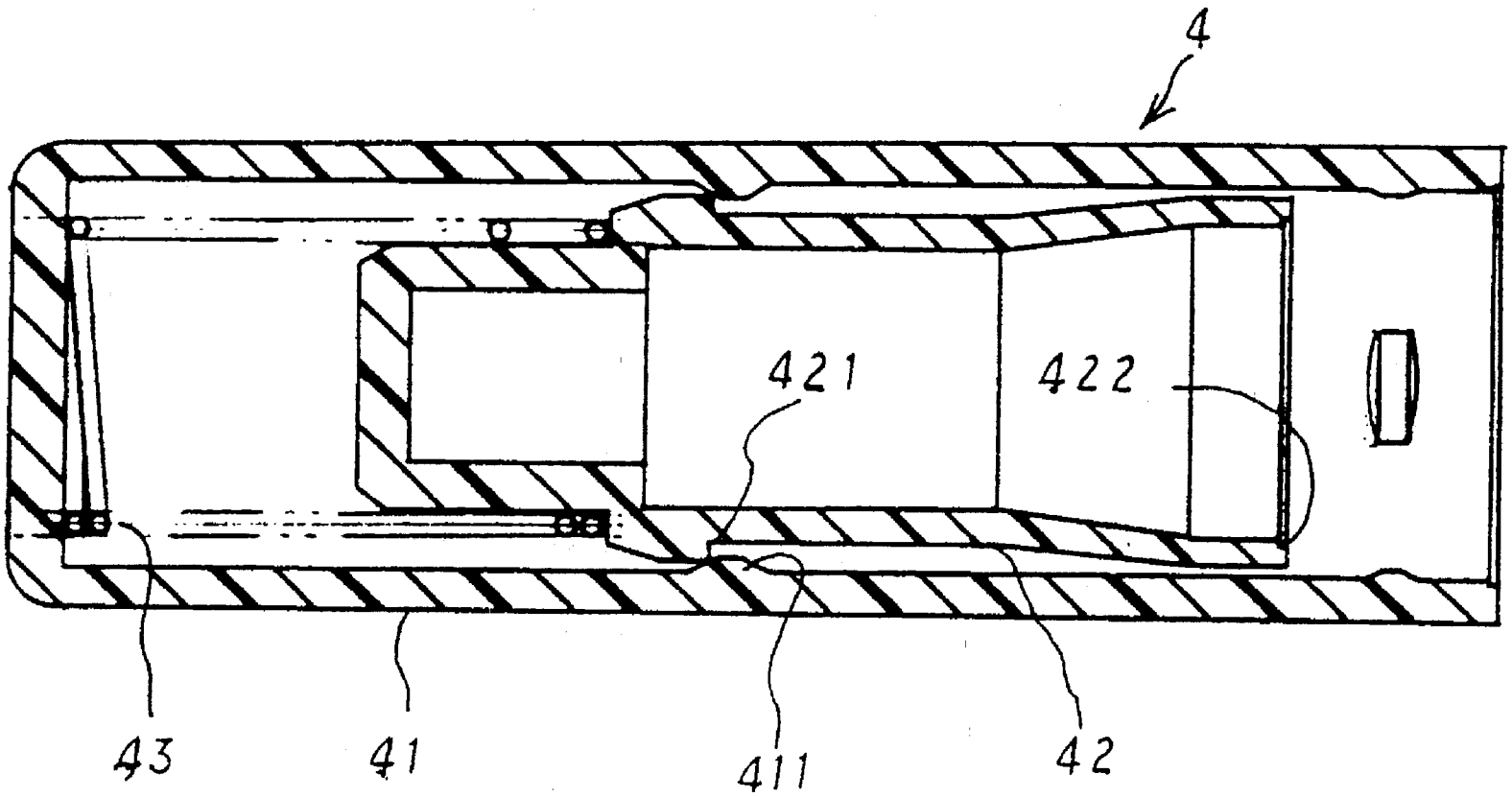
FIG. 2 is a longitudinal sectional view of a double cap unit.

As shown in FIGS. 1 and 2, the double cap unit 4 includes an outer cap 41, an inner cap 42 and a compression coil spring 43. The inner cap 42 is biased outwardly from the outer cap 41 by the compression coil spring 43. However, the inner cap 42 is prevented from coming out of the outer cap 41 since a pawl 421 formed on the exterior of the inner cap 42 engages with a projection 411 formed on the interior of the outer cap 41.

FIG. 2 shows a state of the double cap unit 4 when it is detached from the sleeve holder 1.

Figure 3:
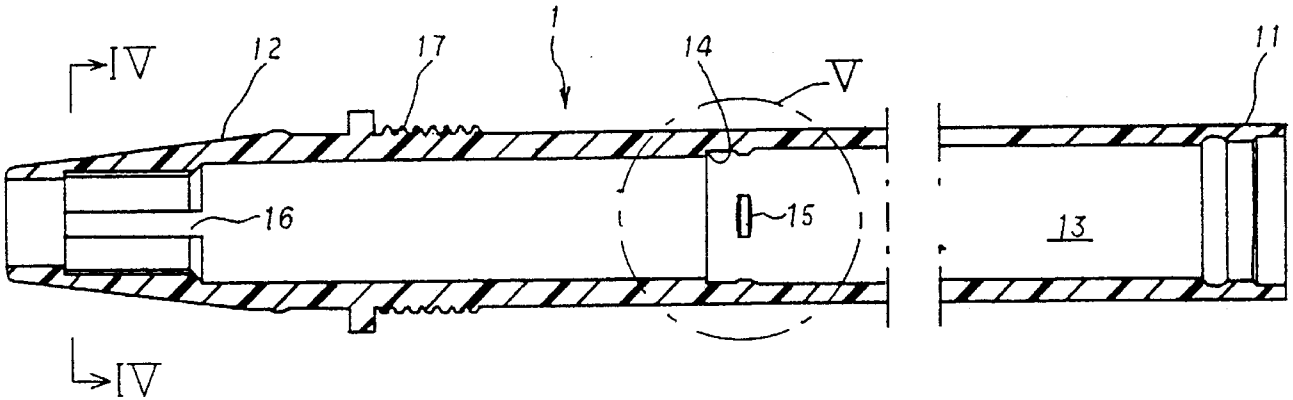
FIG. 3 is a longitudinal sectional view of a sleeve holder.

As best shown in FIG. 3, the sleeve holder 1 is provided on its outer periphery of the front end 12 with a converged tappered portion. As shown in FIG. 1, when the double cap unit 4 is coupled to the front end 12 of the sleeve holder 1, a rear tapered face edge 422 (FIG. 2) of the inner cap 42 linearlly contacts with an outer peripheral tapered face on the front end 12 of the sleeve holder 1. This prevents the cosmetic material from uselessly evaporating from the applying tip 33 when the cosmetic material container is not used.

Figure 5:
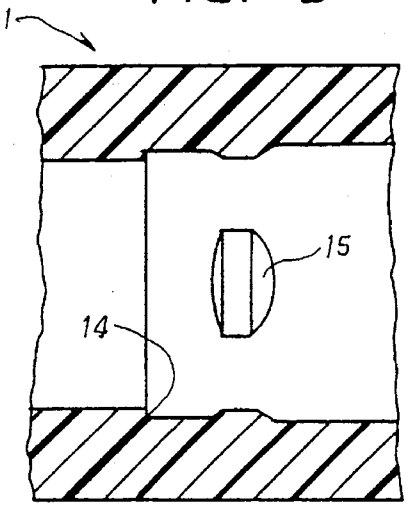
FIG. 5 is an enlarged view of a portion encircled by a circle V in FIG. 3.

As shown in FIGS. 3 and 5, the sleeve holder 1 is provided on its middle interior with a stepped portion 14 formed by a difference in its inner diameters and projections 15. When the adjuster 31 is inserted into the sleeve holder 1 from its rear end 11, a flange 317 (FIG. 7) on a rear end of the adjuster 31 is clamped between the stepped portion 14 and the projections 15.

Figure 4:
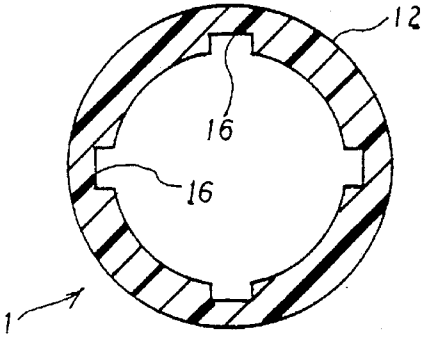
FIG. 4 is a cross sectional view taken along lines IV—IV in FIG. 3.

As shown in FIGS. 3 and 4, the sleeve holder 1 is provided on its interior with at least one vent slot 16. In the embodiment shown in the figures, four vent slots 16 are spaced away equiangularly in the circumferential direction.

Finally, as shown in FIGS. 7 through 10, the adjuster 31 is provided on its outer periphery with at least one slit 314 extending from its front end to its rear end. At least a part of the slit 314 communicates with the axial hole 312 in the adjuster 31. In the embodiment shown in the figures, the slit 314 is formed radially in a lower portion of the adjuster 31 and communicates with the axial hole 312 at the rear end side of the adjuster 31.

The adjuster 31 is provided on the interior of the flange 317 on the rear end of the adjuster 31 with projections 315 so that the projections 315 restrain the joining core 32 from moving in the axial direction in the axial hole 312 when the joining core 32 is inserted into the hole 312 with a given clearance 318 (FIG. 6).

The adjuster 31 is provided in an upper portion of the outer periphery with a vent slot 316 extending in the axial direction. When the applying tip unit 3 is inserted into the sleeve holder 1, the vent slot 316 (FIG. 8) of the adjuster 31 communicates with the vent slot 16 (FIG. 3) described above.

Next, an example of a process for assembling the cosmetic material container of the present invention will be briefly explained below.

First, as shown in FIG. 6, the applying tip unit 3 is formed by press-inserting the applying tip 33 into the socket 313 in the front end of the adjuster 31, inserting the joining core 32 into the axial hole 312 from the rear end of the adjuster 31 and pushing the distal end of the joining core 32 into the rear end of the applying tip unit 3.

Next, the applying tip unit 3 is secured in the sleeve holder 1 by inserting the unit 3 into the sleeve holder 1 from the open rear end 11 and pushing the flange 317 on the rear end of the adjuster 31 onto a space between the stepped portion 14 in the sleeve holder 1 and the projection 15. At this time, the distal end of the applying tip 33 projects from the open front end 12 of the sleeve holder 1 (FIG. 1).

The double cap unit 4 is attached to the front end 12 of the sleeve holder 1 thus assembled. A cosmetic material container constructed in a half assembled state is sterilized. After sterilizing, the cosmetic material is poured into the reservoir 13 from the open rear end of the sleeve holder 1 and the tail plug 2 is fitted into the open rear end 11. Then, all assembling steps are finished.

If desired, a metal cover (not shown) may be mounted on the outer periphery of the sleeve holder 1 and is threadedly fixed on a screw portion 17 on the sleeve holder 1.

Since the pouring step of the cosmetic material and the attaching step of the tail plug after the sterilizing step can be effected automatically, the half assembled container and the other parts are not touched by workers' hands again, thereby eliminating a further sterilizing step.

The cosmetic material is reduced during use of the cosmetic material container. At the same time, air flows into the reservoir 13 through the vent slot 16 and 316 and the clearance 318 between the axial hole 312 and the joining core 32. In the case where a difference between an inner pressure in the reservoir 13 and an outer pressure occurs due to a change of temperature or the like, the cosmetic material will flow between the reservoir 13 and the annular grooves 311 in the adjuster 31, thereby adjusting a change of pressure difference automatically.

According to the present invention, it is possible to decrease the number of parts and assembling steps and to finish the sterilizing by the minimum steps in comparison with the conventional cosmetc material container, thereby obtaining inexpensive products. Further, it is possible to make full use of the cosmetic material in the reservoir since the joining core is made of a porous material, and projects direct into the reservoir in the sleeve holder.

What is claimed is:

1. A cosmetic material container comprising:

a sleeve holder having an open front end and an open rear end wherein said open front end is narrower than said open rear end;

a tail plug for closing said open rear end of said sleeve holder;

an applying tip unit secured to an open front end side of said sleeve holder; and a double cap unit attachably and detachably coupled to said sleeve holder on the outer periphery of its front end;

said applying tip unit including an adjuster provided on its outer periphery with a number of annular grooves, a porous joining core inserted into an axial hole in said adjuster and communicating with a part of said annular grooves, and a porous tip connected to a front end of said joining core and inserted in a socket provided in a front end of said adjuster;

a cosmetic material reservoir being defined between a rear end of said adjuster and a tail end in said sleeve holder;

said porous joining core being disposed in said adjuster to project its rear end in said reservoir;

wherein said sleeve holder is provided on its middle interior with a stepped portion formed by a difference in its inner diameters and projections and wherein said adjuster is secured in said sleeve holder when a rear end of said adjuster is clamped between said stepped portion and said projections when said adjuster is inserted into said open rear end of said sleeve holder;

wherein said sleeve holder is provided on the outer periphery of its front end with a converged tapered portion and wherein said sleeve holder is provided on its interior with at least one vent slot extending in an axial direction; and wherein said adjuster is provided on its outer periphery with at least one slit extending from its front end to its rear end and wherein at least a part of said slit is in communication with said axial hole in said adjuster.

2. A cosmetic material container according to claim 1, wherein said double cap unit includes an outer cap, an inner cap and a compression coil spring and wherein said inner cap is biased outwardly by said spring so that said inner cap linearlly contacts with the outer periphery of the front end of said sleeve holder when said double cap unit is coupled to said sleeve holder.

* * * * *

UNITED STATES PATENT AND TRADEMARK OFFICE

CERTIFICATE OF CORRECTION

PATENT NO. : 5,551,789
DATED : September 3, 1996
INVENTOR(S) : Akira Okawa and Yuji Sugaya It is certified that error appears in the above-identified patent and that said Letters Patent is hereby corrected as shown below:

Title page,
Item [73], Assignee, should read as follows:
-- [73] Assignees: Kawakami Giken Co., LTD., Tokyo, Japan;
Tokiwa Corporation, Gifu, Japan --

Signed and Sealed this

Second Day of December, 2003

JAMES E. ROGAN
*Director of the United States Patent and Trademark Office*